United States Patent [19]

Fulier

[11] Patent Number: 4,698,993

[45] Date of Patent: Oct. 13, 1987

[54] RIVETING TOOL FOR ONE SIDE RIVETING OF RIVET NUTS

[75] Inventor: Jozef Fulier, Nove Mesto nad Vahom, Czechoslovakia

[73] Assignee: Jednote rolnicke druzstvo Slovenskeho narodneho, Bosaca, Czechoslovakia

[21] Appl. No.: 853,165

[22] Filed: Apr. 17, 1986

[51] Int. Cl.[4] ..... B21J 15/34

[52] U.S. Cl. ..... 72/114; 72/391; 72/454

[58] Field of Search ..... 72/114, 391, 461, 454; 29/453.52

[56] References Cited

U.S. PATENT DOCUMENTS

| | | | |
|---|---|---|---|
| 3,462,988 | 8/1969 | Tudor et al. | 72/114 |
| 3,728,882 | 4/1973 | Rigot et al. | 72/114 |
| 3,861,185 | 1/1975 | Maddox | 72/114 |
| 4,121,444 | 10/1978 | Duran | 72/114 |
| 4,400,960 | 8/1983 | Martin | 72/114 |
| 4,402,203 | 9/1983 | Molina | 72/114 |

FOREIGN PATENT DOCUMENTS

| | | | |
|---|---|---|---|
| 2558083 | 7/1985 | France | 72/114 |

*Primary Examiner*—Robert L. Spruill
*Assistant Examiner*—David B. Jones

[57] ABSTRACT

A riveting tool of simple design adapted for repeated one side riveting of rivet nuts particularly in mass production and also suitable for use with a reversible motor drive is provided with a single-threaded pull mandrel and a dolly with an opening corresponding to the external cross section of the threaded pull mandrel. The dolly is slidably arranged on the mandrel. A claw clutch having an upper and a lower part is arranged so that the upper surface of the body of the dolly contacts the lower part of the claw clutch. A retaining element with an opening corresponding to the external cross section of the threaded pull mandrel is freely turnable on the mandrel and the lower part of the retaining element contacts the upper part of the claw clutch for engagement with the lower part of the clutch. A tightening nut is screwed on the upper part of said mandrel. In another embodiment of the invention, an adjustable stop is fixed on the threaded pull mandrel above the tightening nut.

2 Claims, 4 Drawing Figures

RIVETING TOOL FOR ONE SIDE RIVETING OF RIVET NUTS

BACKGROUND OF THE INVENTION

The invention relates to a riveting tool for one side riveting of rivet nuts.

Known assembling jigs and tools for one side riveting comprise a pull mandrel having a hexagonal profile, a retaining element, and a nut controlled by a cap key. The pull mandrel is screwed out of the rivet nut manually. Riveting tongues and other riveting devices are rather complicated and expensive, particularly in case of smaller series or as piece work.

SUMMARY OF THE INVENTION

It is an object of this invention to provide a riveting tool for one side riveting of rivet nuts which would reduce manufacturing costs and which would also allow riveting with application of a reversible drive (e.g. electric drill) with an adjustable torque, thus enabling the application of this tool for mass manufacture.

The riveting tool according to the present invention, comprises a threaded pull mandrel with a dolly and a tightening nut, said dolly being longitudinally slidably arranged on the threaded pull mandrel so as to prevent its turning on the mandrel. The body of the dolly is provided with the lower part a claw clutch, the upper part of this claw clutch being part of a retaining element arranged turnably on the threaded pull mandrel between the dolly and between the tightening nut. An adjustable stop can be provided on the threaded pull mandrel.

The present invention achieves a substantial reduction of manufacturing costs so that conditions are created for a wider and more economical application of rivet nuts. Another particular advantage is the ability to use this tool in connection with a reversible drive with adjustable torque, that it can also be applied for high performance riveting in mass production.

BRIEF DESCRIPTION OF THE DRAWINGS

With these and other objects in view, which will become apparent in the following detailed description, the present invention, which is shown by example only, will be clearly understood in connection with the accompanying drawing, in which.

DETAILED DESCRIPTION OF THE PREFERRED EMBODIMENT

Figure 1:
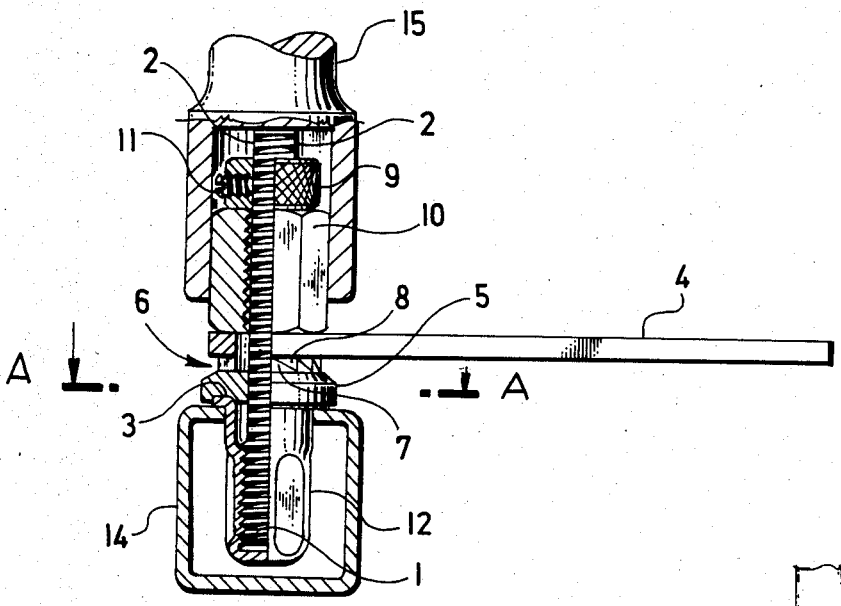
FIG. 1 is an elevational view with a partial axial section.
Figure 2:
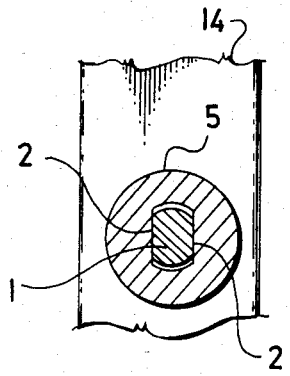
FIG. 2 is a sectional view taken along the plane indicated on FIG. by A—A.

FIG. 1 shows a riveting tool with a rivet nut screwed on the lower part of a threaded pull mandrel, prepared for insertion into an opening of a component in which it is supposed to be fixed. The riveting tool as shown in the drawing comprises a threaded pull mandrel 1, the upper part of which is in this case provided with flattenings 2. A dolly 5 with a recess 3 at its lower surface and with an opening corresponding to the flattened part of the pull mandrel 1 is shifted on this flattened part of the threaded pull mandrel 1. The lower part 7 of a claw clutch 6 is arranged on the upper surface of the dolly 5. A retaining element 4, shown in the figures as bar shape with an opening corresponding to the external cross section of the mandrel 1, is slid on the mandrel so that it can be turned on the mandrel 1. The lower surface of the retaining element 4 is provided above the dolly 5 with the upper part 8 of claw clutch 6 for engagement with the lower part 7 of the clutch 6 on the dolly 5. A tightening nut 10 is screwed on the threaded pull mandrel 1 and an adjustable stop 9 is fixed above the tightening nut 10 on the mandrel 1 by a locking screw 11.

Figure 3:
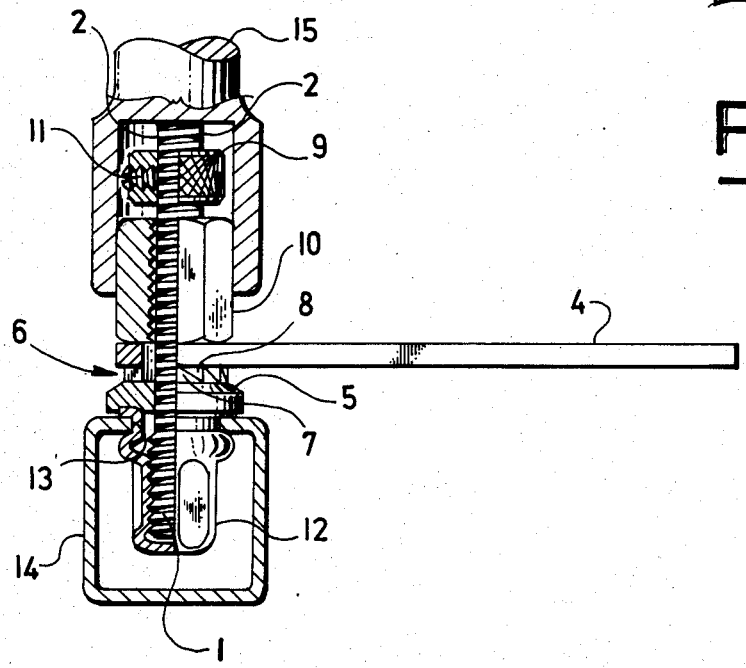
FIG. 3 is a view similar to FIG. 1 showing a rivet nut rivetted to a component.
Figure 4:
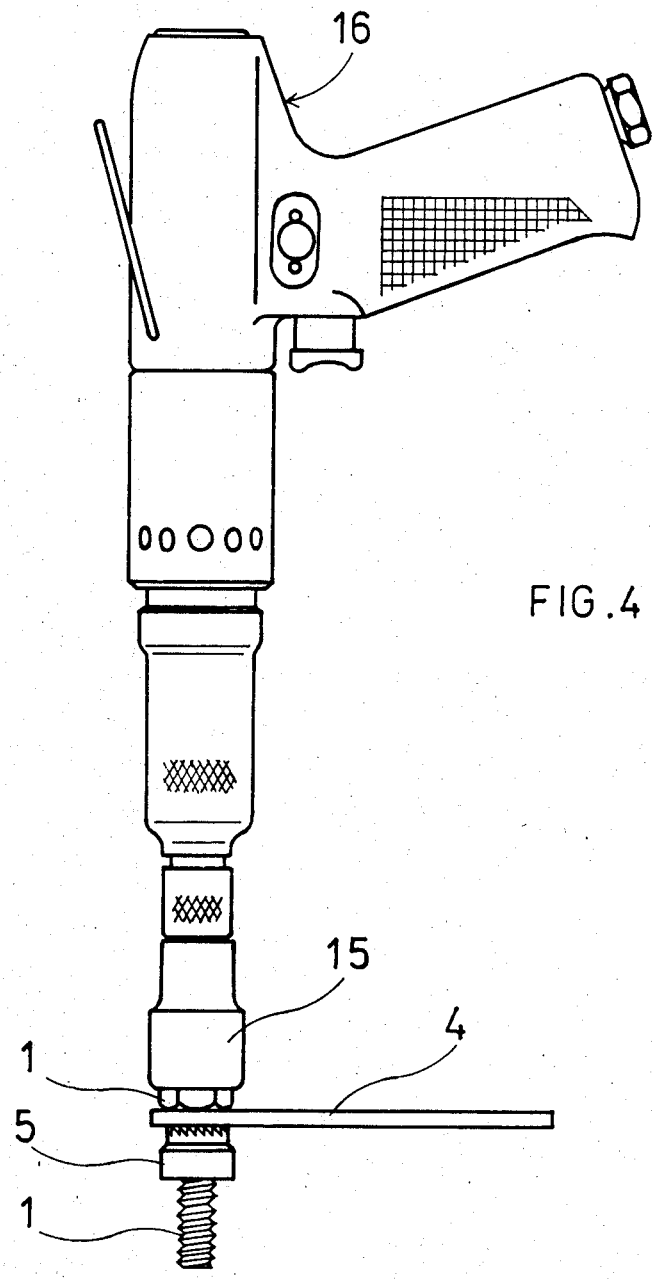
FIG. 4 is a view similar to FIGS. 1 and 3 showing one embodiment of the invention used with a reversible electric drill.

The riveting tool is operated as follows: A rivet nut 12 is screwed on the lower part of the threaded pull mandrel 1. In case the rivet nut 12 is closed at its bottom, the mandrel 1 is screwed in up to the bottom of the rivet nut. In case the nut has a through going opening, the end of the threaded pull mandrel 1 extends from the rivet nut 12 for about one thread. The dolly 5 is slid on the mandrel 1 so that its recess 3 comes in engagement with the upper extended part of the rivet nut 12. The retaining element 4 is thereafter slid on the mandrel 1 and the whole is mutually connected by the tightening nut 10. The position of the tightening nut 10 is secured by a stop 9 with a locking screw 11. The whole riveting tool with the rivet nut 12 is thereafter introduced into the respective opening 13 of a component 14 where the rivet nut 12 is to be fixed. The proper riveting is performed either manually by means of a wrench, or e.g. by means of an electric drill 16 attached to the riveting head 15 as shown in FIG. 4, by turning the tightening nut 10 for a predetermined extent while simultaneously preventing any turning of the dolly 5 by the retaining element 4. In the course of this turning of the tightening nut 10 a bulge of the rivet nut 12 is created below the lower surface of the component 14 to which the rivet nut 12 is to be fixed as is shown in FIG. 3, completing thus the riveting.

After finished riveting, the threaded pull mandrel 1 is, by means of the tightening nut 10 by reverse turning, screwed out of the rivet nut 12 either manually or by means of a motor 16 as shown in FIG. 4, whereby the tightening nut 10 is first loosened and after it comes in engagement with the adjustable stop 9, the threaded pull mandrel 1 is screwed out of the rivet nut whereby also parts of the claw clutch 6 come out of engagement.

After removal of the riveting tool another rivet nut 12 can be screwed on the free end of the threaded pull mandrel 1. In case the used rivet nuts 12 are of an approximately equal length, the adjustable stop 9 need not be again adjusted if it has been prior adjusted for the longest used rivet nut 12.

Although the invention is described and illustrated with reference to a preferred embodiment thereof, it is to be expressly understood that it is in no way limited to the disclosure of such preferred embodiments but is capable of numerous modifications within the scope of the appended claims.

We claim:

1. A riveting tool for one side riveting of rivet nuts comprising:

a threaded pull mandrel having a single standard thread along its entire length and an oblate cross section along part of its length;

a dolly with a single axial bore corresponding to the oblate cross section of the threaded pull mandrel, said dolly being slidably arranged on said mandrel;

a claw clutch having an upper and a lower part, the body of said dolly being provided on its upper surface with the lower part of said clutch;

a retaining element with a circular opening corresponding to the external cross section of the threaded pull mandrel, said retaining element being freely turnable on said mandrel, the lower part of the retaining element being provided with the upper part of the claw clutch for engagement with the lower part of the clutch; and a tightening nut screwed on the upper part of said mandrel.

2. A riveting tool as claimed in claim 1, further comprising an adjustable stop fixed on the threaded pull mandrel above the tightening nut.

* * * * *